US009854874B2

(12) United States Patent
Wang

(10) Patent No.: US 9,854,874 B2
(45) Date of Patent: Jan. 2, 2018

(54) ADJUSTABLE DEVICE WITH HOOK STRUCTURE

(71) Applicant: Meng-Chun Wang, Taichung (TW)

(72) Inventor: Meng-Chun Wang, Taichung (TW)

( * ) Notice: Subject to any disclaimer, the term of this patent is extended or adjusted under 35 U.S.C. 154(b) by 300 days.

(21) Appl. No.: 14/793,952

(22) Filed: Jul. 8, 2015

(65) Prior Publication Data

US 2017/0006969 A1 Jan. 12, 2017

(51) Int. Cl.
*A43C 1/06* (2006.01)
*A41F 1/04* (2006.01)
*A43C 3/00* (2006.01)

(52) U.S. Cl.
CPC ..... *A43C 1/06* (2013.01); *A41F 1/04* (2013.01); *A43C 3/00* (2013.01)

(58) Field of Classification Search
CPC .... A43C 1/06; A43C 3/00; A43C 5/00; A41F 1/04
USPC ..... 450/114, 119; 24/713.6, 713.9; 602/12, 602/19; 128/101.1, 100.1
See application file for complete search history.

(56) References Cited

U.S. PATENT DOCUMENTS 5,566,474 A * 10/1996 Leick ..... A43C 1/00 24/713.4
8,409,122 B2 * 4/2013 Cropper ..... A61F 5/024 128/876
8,864,695 B2 * 10/2014 Thornton ..... A61F 5/028 128/96.1

FOREIGN PATENT DOCUMENTS

TW M473202 3/2014

* cited by examiner

*Primary Examiner* — Jack W Lavinder
(74) *Attorney, Agent, or Firm* — Muncy, Geissler, Olds & Lowe, P.C.

(57) ABSTRACT

An adjustable device with a hook structure is provided, including: two plate bodies, for being oppositely disposed on an article, at least one said plate body integrally formed with at least one hook structure protrusively on a surface thereof, the hook structure formed with a receiving slot and including an engaging portion, the engaging portion including a free end, the free end and the surface of the plate body formed with a passage therebetween, the passage communicated with the receiving slot, a width of the passage smaller than a width of the receiving slot; a connecting portion, connected between the two plate bodies, at least a part of the connecting portion received in the receiving slot, the connecting portion for being selectively operated to link the two plate bodies.

9 Claims, 7 Drawing Sheets

ADJUSTABLE DEVICE WITH HOOK STRUCTURE

BACKGROUND OF THE INVENTION

Field of the Invention

The present invention relates to a hook device, and more particularly to an adjustable device with a hook structure Description of the Prior Art Usually, a restraining structure as disclosed in TWM473202 at least includes an assistive device, two inner restraining bases, two outer restraining bases and a binding rope. Each said inner restraining base has a plurality of rolling wheels, and each said outer restraining base is located on an outer side of the inner restraining base and has rolling wheels. The binding rope is tangled on the rolling wheels and has a free end for being operated by a user.

However, the above-mentioned restraining structure has to be used in cooperation with the rolling wheels; therefore, the restraining structure has a more complex structure. In addition, because the restraining structure has too many members and greater weight, it requires higher cost to maintain or produce the structure. Furthermore, when the user uses the restraining structure, it is inconvenient to operate the restraining structure.

The present invention has arisen to mitigate and/or obviate the afore-described disadvantages.

SUMMARY OF THE INVENTION

The major object of the present invention is to provide an adjustable device with a hook structure which has an integrally formed plate body structure and is convenient and cost-saving to be manufactured. In addition, the adjustable device has the hook structure for engagement and preventing disengagement and is reusable, and the adjustable device is detachably assembled to an article.

To achieve the above and other objects, an adjustable device with a hook structure is provided, including: two plate bodies, for being oppositely disposed on an article, at least one said plate body integrally formed with at least one hook structure protrusively on a surface thereof, the hook structure formed with a receiving slot and including an engaging portion, the engaging portion having a free end, the free end and the surface of the plate body formed with a passage therebetween, the passage communicated with the receiving slot, a width of the passage being smaller than a width of the receiving slot; and a connecting portion, connected between the two plate bodies, at least a part of the connecting portion received in the receiving slot, the connecting portion for being selectively operated to link the two plate bodies.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
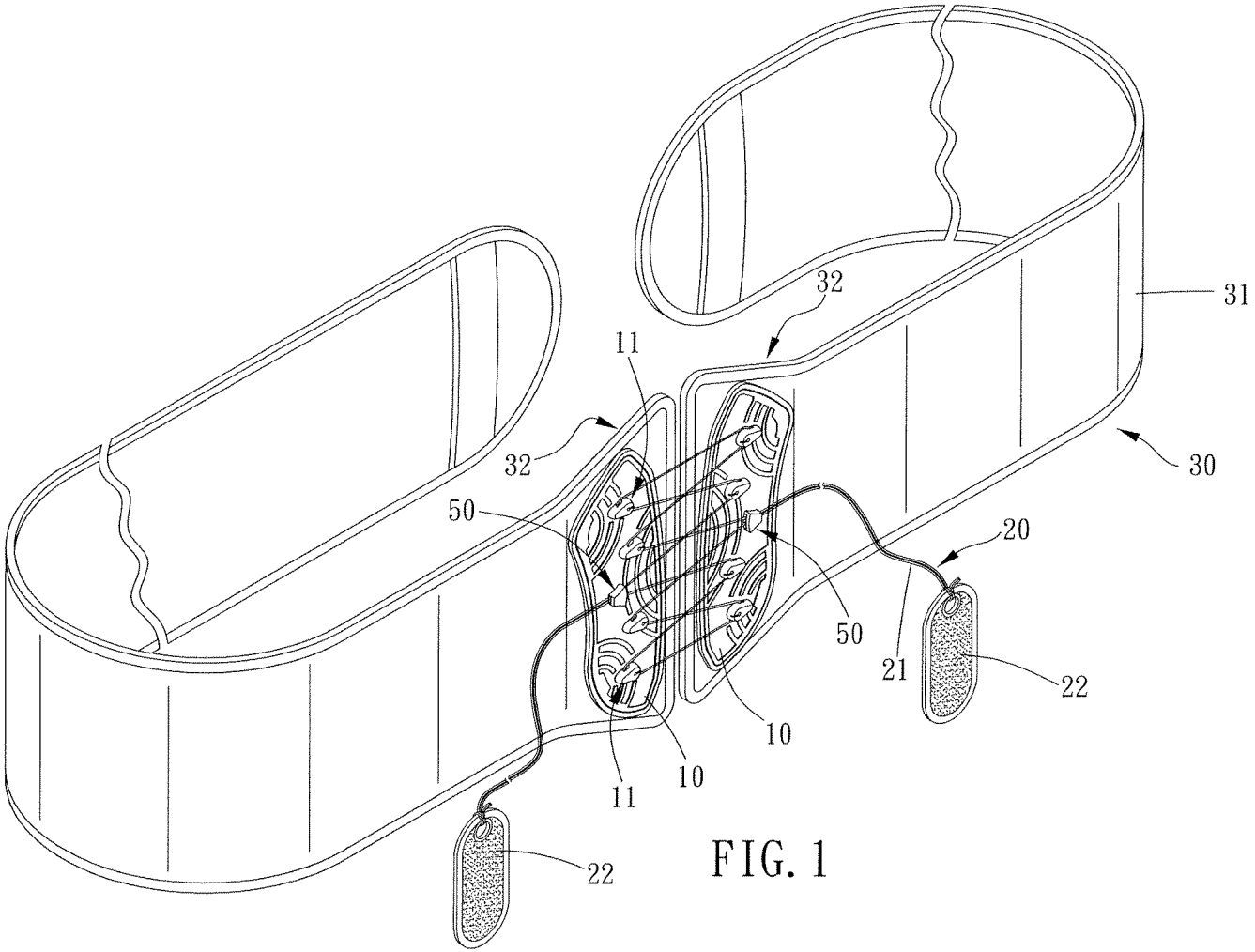
FIG. 1 is a drawing showing a first preferred embodiment of the present invention.
Figure 2:
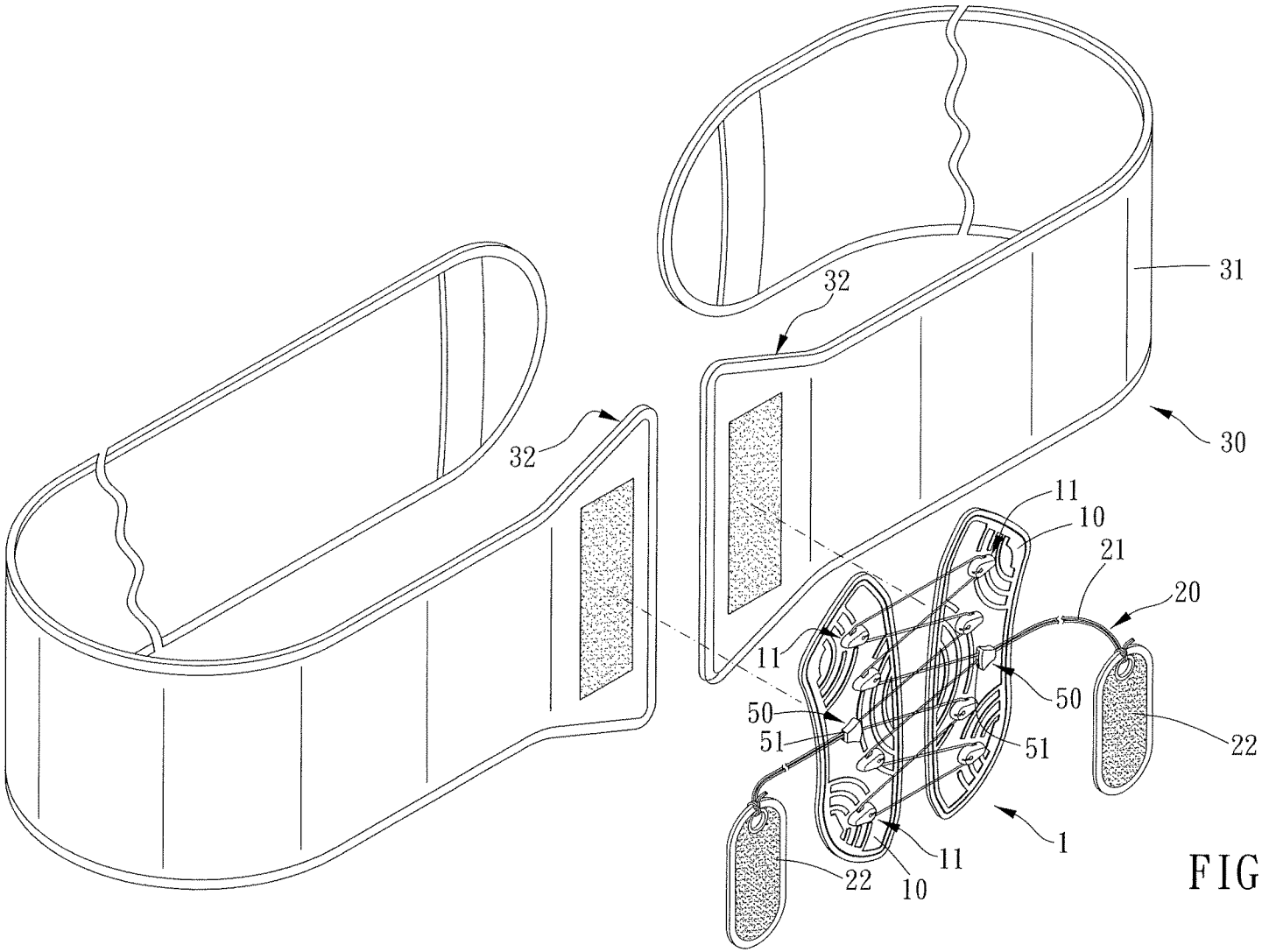
FIG. 2 is a breakdown drawing of the first preferred embodiment of the present invention.
Figure 3:
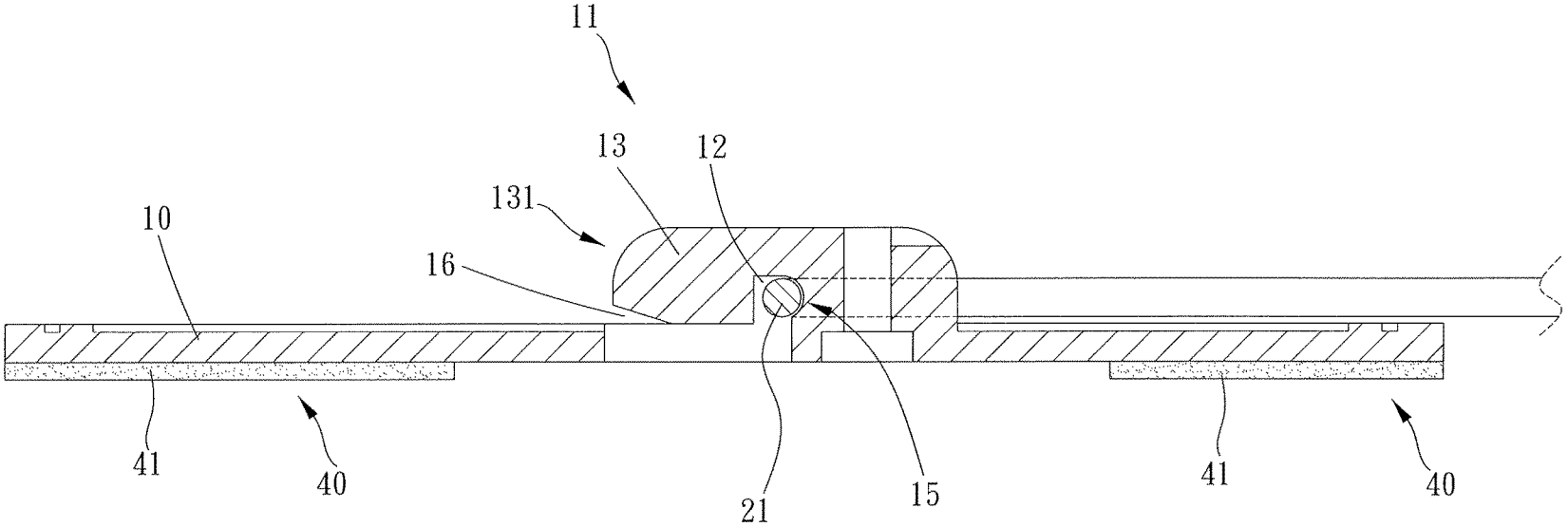
FIG. 3 is a cross-sectional drawing of the first preferred embodiment of the present invention.
Figure 4:
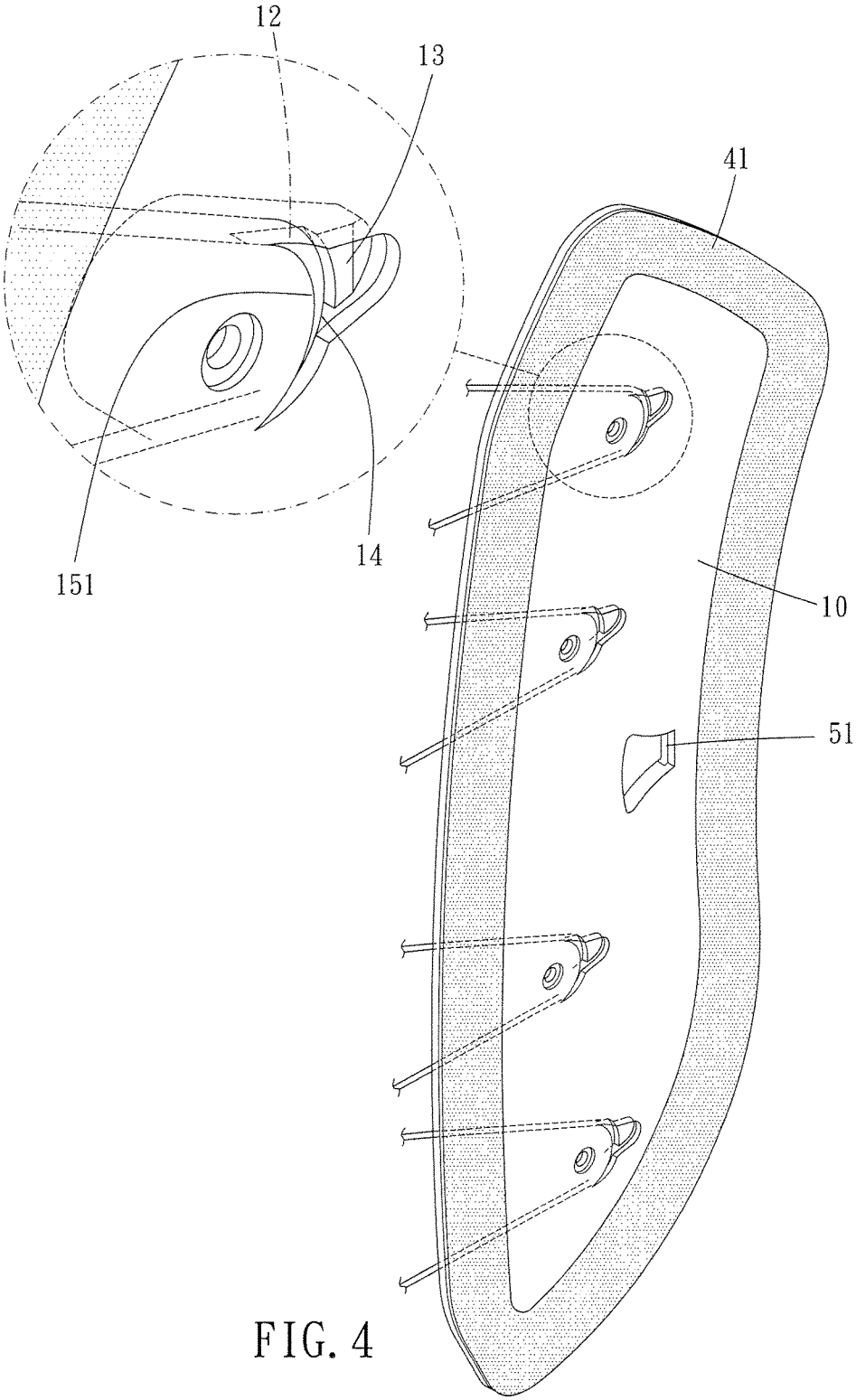
FIG. 4 is another drawing showing the first preferred embodiment of the present invention.
Figure 5:
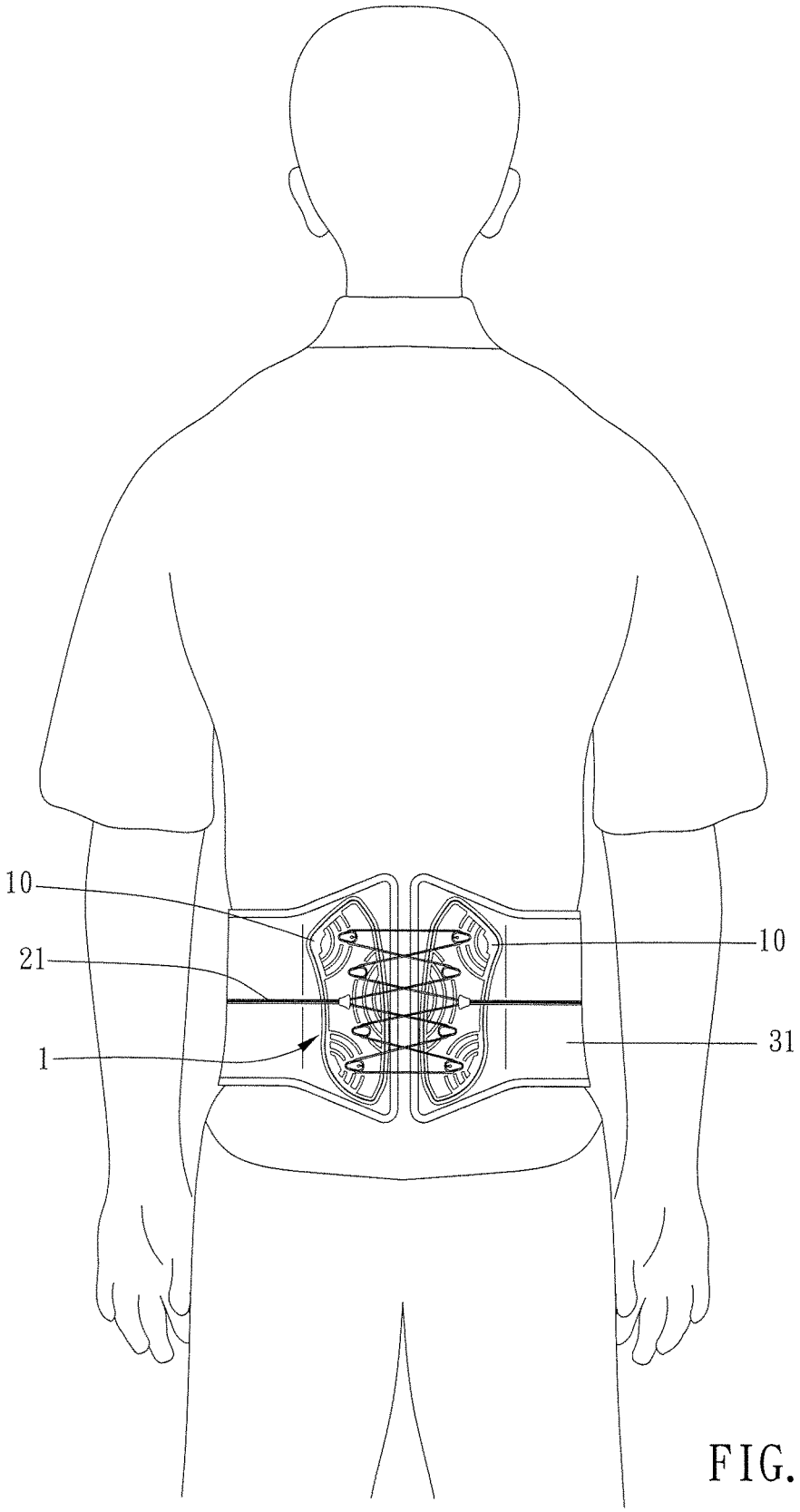
FIG. 5 is a drawing showing the first preferred embodiment of the present invention in use.

The present invention will be clearer from the following description when viewed together with the accompanying drawings, which show, for purpose of illustrations only, the preferred embodiment in accordance with the present invention.

Please refer to FIGS. 1 to 5 for a first preferred embodiment of the present invention. An adjustable device 1 with a hook structure at least includes two plate bodies 10 and a connecting portion 20.

The two plate bodies 10 are for being oppositely disposed on an article 30. For example, the article 30 may be a protective equipment 31 (the article 30 may also be clothes or shoes), and the protective equipment 31 may have two wing portions 32 which are movable relative to each other. The two plate bodies 10 are assembled to the two wing portions 32 respectively. At least one said plate body 10 is integrally and protrusively formed with at least one hook structure 11 on a surface thereof. In this embodiment, the two plate bodies 10 are respectively protrusively formed with a plurality of hook structures 11 which are arranged in intervals, and each said hook structure 11 is formed with a receiving slot 12 and include an engaging portion 13, a recess 14 and an abutting portion 15.

Specifically, the recess 14 is disposed on the surface of the plate body 10, and a circumferential surface of the recess 14 is connected with an abutting portion 15. The engaging portion 13 has a free end 131, and the engaging portion 13 integrally extends from the abutting portion 15 toward a direction to form the free end 131. More specifically, the engaging portion 13 and the abutting portion 15 define the receiving slot 12 therebetween, and a passage 16 is formed between the free end 131 and the surface of the plate body 10 so that the passage 16 and the receiving slot 12 are communicable with each other.

In this embodiment, the free end 131 is arranged neighboring to the surface of the plate body 10, and the engaging portion 13 is disposed at an end of the recess 14. It is to be noted that a width of the passage 16 is smaller than a width of the receiving slot 12. Preferably, the engaging portion 13 is flexible and transformable; therefore, when the engaging portion 13 is pushed or pulled by a force, the engaging portion 13 can transform to widen the width of the passage 16 so as to facilitate installation of a member such as a rope member 21 to the hook structure 11. Furthermore, a side of the free end 131 facing the passage 16 may be formed with a guide bevel to allow the rope member 21 to be engaged with the hook structure 11 more easily.

The connecting portion 20 is connected between the two plate bodies 10, and at least a part of the connecting portion 20 is received in the receiving slot 12. Specifically, the connecting portion 20 can be disposed through the receiving slot 12 and restrictedly arranged between the hook structure 11 and the surface of the plate body 10. For example, the connecting portion 20 may include at least one said rope member 21, and the rope member 21 may be disposed through the receiving slots 12 of the two plate bodies 10 and restrictedly engaged with the hook structure 11. In addition, the rope member 21 may be interlacedly arranged and engaged with the hook structures 11 of the two plate bodies 10, and the rope member 21 may be slidable within the receiving slots 12.

In actual practice, the plate body 10 may further include an assembling portion 40, and the assembling portion 40 may be for being detachably assembled with the article 30. For example, the assembling portion 40 may include a first sticking portion 41 (the first sticking portion 41 may be a Velcro or an inert adhesive) which is arranged on a side of the plate body 10, and the first sticking portion 41 may be for being detachably stuck with the article 30. More specifically, in this embodiment, the two plate bodies 10 are stuck with the two wing portions 32 through, for example, the first sticking portion 41 respectively, and the two plate bodies 10 may be disengaged from the two wing portions 32 and reusable.

A side of the abutting portion 15 is formed with an arched protrusion 151 protrusive toward the free end 131. The connecting portion 20 abuts against the arched protrusion 151, and the connecting portion 20 may be selectively operated to link the two plate bodies 10. Furthermore, the two plate bodies 10 are symmetrically arranged and movable relative to each other. When the rope member 21 is pulled by a force, the rope member 21 abuts against and pushes the arched protrusion 151 of the abutting portion 15 to drive the two plate bodies 10 to move toward each other. Preferably, the arched protrusion 151 is convex so that the rope member 21 is flexibly tight-fit to the arched protrusion 151, and the rope member 21 is slidable relative to the arched protrusion 151 smoothly. When the two plate bodies 10 move toward each other, the two wing portions 32 move toward each other with the two plate bodies 10 to make the protective equipment 31 restrain a body of a user.

Furthermore, the hook structures 11 are arranged substantially along a direction, and the hook structures 11 may be arranged in equal or unequal intervals. Each said plate body 10 may be integrally and protrusively formed with a restraining portion 50, and each said restraining portion 50 may have a through hole 51. Two opposite ends of the rope member 21 may be slidably positioned in the restraining portions 50 of the two plate bodies 10 respectively. It is to be noted that the restraining portion 50 of each said plate body 10 is correspondingly disposed on a direction of a symmetrical center of the hook structures 11 (however, in other embodiments, the restraining portion 50 may be disposed on other positions of the plate body 10, for example, by a distal end of an arrangement of the hook structures 11) so that when the rope member 21 is pulled, the plate body 10 may be movable along the direction of the symmetrical center, and the two plate bodies 10 may approach each other stably. Furthermore, tow opposite ends of the connecting portion 20 (in this embodiment, the connecting portion 20 is the rope member 21) may be formed with a second sticking portion 22 (the second sticking portion 22 may be a Velcro or an inert adhesive) respectively. The second sticking portion 22 may be for being detachably stuck with the article 30 to fix two opposite ends of the connecting portion 20.

It is to be noted that the plate body 10 (including the hook structure 11 and the restraining portion 50) which is integrally formed may be made of plastic and be formed by plastic injection molding, so the plate body 10 is convenient and cost-saving to be manufactured. In addition, the rope member 21 may be disengaged with the hook structure 11 and reusable.

Figure 6:
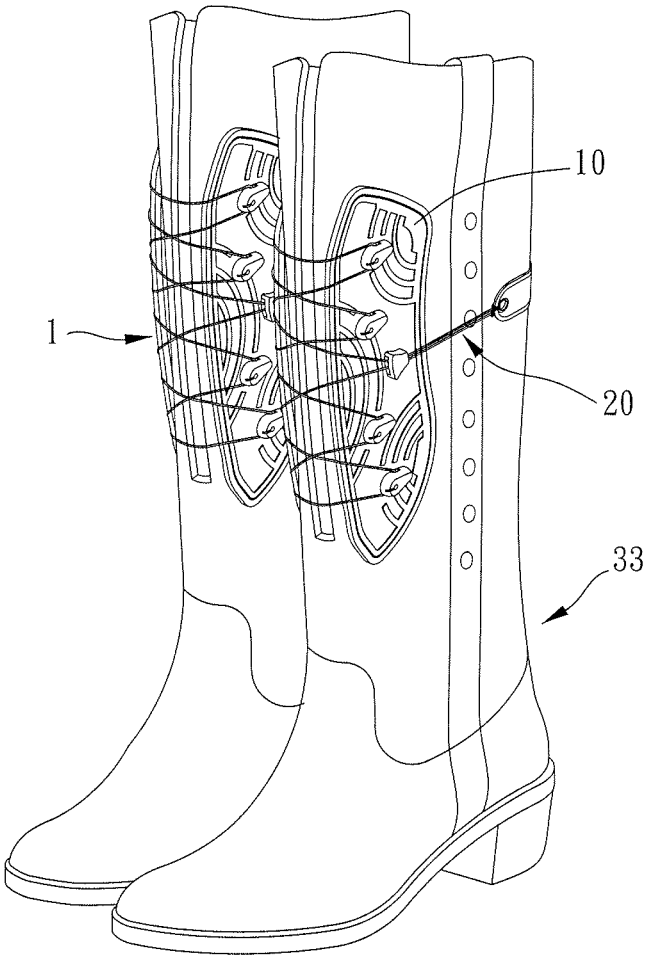
FIG. 6 is a drawing showing a second embodiment of the present invention.

In a second embodiment as shown in FIG. 6, the adjustable device 1 with the hook structure may be assembled to a shoe body 33. When the two plate bodies 10 are pulled via the connecting portion 20, the two plate bodies 10 may be used to tie a shoe opening of the shoe body 33 or to maintain an appearance or a shape of the shoe body 33.

Figure 7:
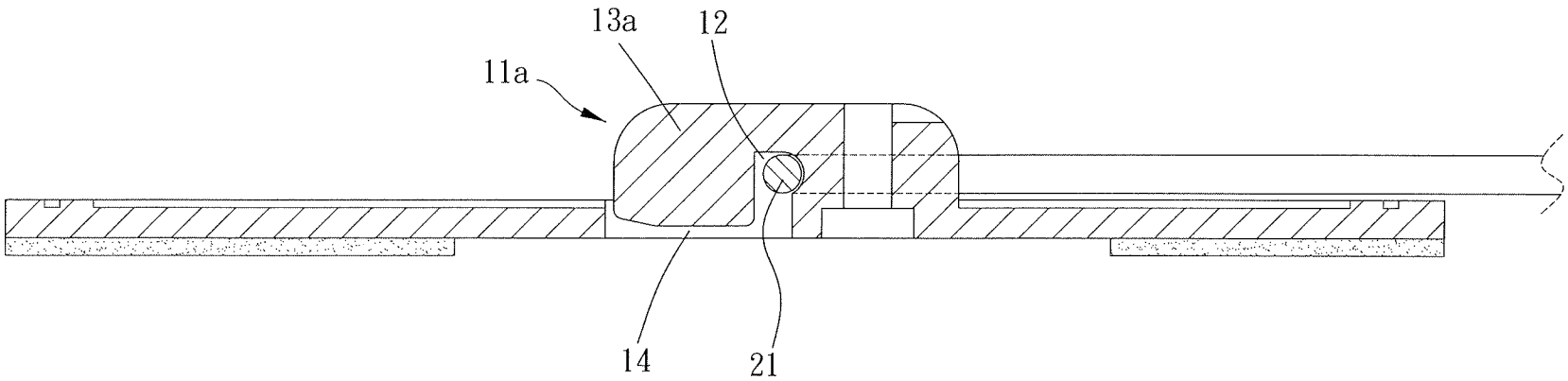
FIG. 7 is a cross-sectional drawing of a third embodiment of the present invention.

In a third embodiment as shown in FIG. 7, at least a part of an engaging portion 13*a* may be received in the recess 14 to prevent the rope member 21 which is disposed through the receiving slot 12 from dislocating from a hook structure 11*a*.

Given the above, the adjustable device is integrally formed and has a simple structure, so it is convenient and cost-saving to manufacture the adjustable device. In addition, the adjustable device has the hook structure for engagement and preventing disengagement and is reusable, and the adjustable device is detachably assembled to an article.

While we have shown and described various embodiments in accordance with the present invention, it should be clear to those skilled in the art that further embodiments may be made without departing from the scope of the present invention.

What is claimed is:

1. An adjustable device with a hook structure, including:

two plate bodies, for being oppositely disposed on an article, at least one said plate body integrally formed with at least one hook structure protrusively on a surface thereof, the hook structure formed with a receiving slot and including an engaging portion, the engaging portion having a free end, the free end and the surface of the plate body formed with a passage therebetween, the passage communicated with the receiving slot, a width of the passage being smaller than a width of the receiving slot;

a connecting portion, connected between the two plate bodies, at least a part of the connecting portion received in the receiving slot, the connecting portion for being selectively operated to link the two plate bodies;

wherein a recess is located in the plate body adjacent the hook structure, and at least a part of the engaging portion is received in the recess.

2. The adjustable device with the hook structure of claim 1, wherein the connecting portion includes at least one rope member, and the rope member is disposed through the receiving slots of the two plate bodies and strictedly disposed within the hook structure.

3. The adjustable device with the hook structure of claim 2, wherein the plate body is formed with a plurality of the hook structures which are arranged in intervals, and the rope member is interlacedly arranged and engaged with the hook structures of the two plate bodies.

4. The adjustable device with the hook structure of claim 3, wherein the two plate bodies are symmetrically arranged and movable relative to each other, the two plate bodies are formed with a plurality of the hook structures respectively, the hook structures are arranged substantially along a direction, each said plate body is integrally and protrusively formed with a restraining portion, each said restraining portion has a through hole, each restraining portion of each said plate body is correspondingly disposed on a direction of a symmetrical center of the hook structures, and two opposite ends of the rope member are disposed through the through holes of the two restraining portions respectively.

5. The adjustable device with the hook structure of claim 1, wherein the hook structure includes an abutting portion, the engaging portion extends integrally from the abutting portion toward a direction to form the free end, the engaging portion and the abutting portion define the receiving slot therebetween, and the connecting portion is disposed through the receiving slot and restrictedly arranged between the hook structure and the surface of the plate body.

6. The adjustable device with the hook structure of claim 5, wherein a side of the abutting portion is formed with an arched protrusion protrusive toward the free end, and the connecting portion abuts against the arched protrusion.

7. The adjustable device with the hook structure of claim 1, wherein the plate body includes an assembling portion, and the assembling portion is for being detachably assembled with the article.

8. The adjustable device with the hook structure of claim 7, wherein the assembling portion includes a first sticking portion which is arranged on a side of the plate body, and the first sticking portion is for being detachably stuck with the article.

9. The adjustable device with the hook structure of claim 1, wherein each of two opposite ends of the connecting portion has a second sticking portion, and the second sticking portion is for being detachably stuck with the article.

* * * * *